United States Patent [19]

Kitchener et al.

[11] Patent Number: 4,761,166

[45] Date of Patent: Aug. 2, 1988

[54] COMPRESSOR SYSTEM

[75] Inventors: Anthony J. Kitchener, Richmond, Australia; Gerd Cromm, Dortmund, Fed. Rep. of Germany

[73] Assignee: Cash Engineering Research Pty. Ltd., Richmond, Australia

[21] Appl. No.: 2,945

[22] Filed: Jan. 13, 1987

[30] Foreign Application Priority Data

Jan. 21, 1986 [AU] Australia ..... PH04286
Nov. 13, 1986 [AU] Australia ..... PH08942

[51] Int. Cl.[4] ..... B01D 29/44

[52] U.S. Cl. ..... 55/385 R; 55/467; 55/473

[58] Field of Search ..... 55/385 R, 467, 471, 55/473

[56] References Cited

U.S. PATENT DOCUMENTS

| | | | |
|---|---|---|---|
| Re. 29,378 | 8/1977 | Bloom | 55/473 |
| 2,642,148 | 6/1953 | Grisé | 55/473 X |
| 3,291,385 | 12/1966 | Williams et al. | 55/467 X |
| 3,708,959 | 1/1973 | Soumerai et al. | 55/473 X |
| 3,736,074 | 5/1973 | Kilbane et al. | 55/467 X |
| 3,768,236 | 10/1973 | Rudge | 55/473 X |
| 3,989,490 | 11/1976 | Adalbert et al. | 55/473 X |
| 4,010,016 | 3/1977 | Haugen | 55/473 |
| 4,255,099 | 3/1981 | Komori | 55/467 X |
| 4,627,861 | 12/1986 | Ibaraki et al. | 55/473 X |
| 4,657,487 | 4/1987 | Schönwald et al. | 55/473 X |

FOREIGN PATENT DOCUMENTS

| | | | |
|---|---|---|---|
| 96268 | 7/1939 | Sweden | 55/473 |

*Primary Examiner*—Robert Spitzer
*Attorney, Agent, or Firm*—Bell, Seltzer, Park & Gibson

[57] ABSTRACT

A compressor system arrangement of the type arranged to compress a liquid gas/mixture and discharge same into a separator vessel where the compressed gas is separated from the liquid and passed to a clean compressed gas outlet. To make such compressor systems competitive with other gas compressors it is necessary to make the overall system package smaller and to achieve this in accordance with the present invention, the compressor (7) is housed substantially within the separator vessel (2) and the filter element (4) is annularly disposed adjacent to a circumferential wall (22) of the separator vessel (2) with the filter element 4 being preferably housed within a dry sump compartment defined by a partition wall (40) with one or more access openings (42,63,3) located in an upper region of the separator vessel (2) in a position of use of the compressor system.

10 Claims, 5 Drawing Sheets

COMPRESSOR SYSTEM

The present invention relates to developments in screw compressor systems first disclosed in Australian Provisional Patent Applications Nos. PH04286 and PH08942 respectively filed on the Jan. 21, 1986 and the Nov. 13, 1986. While the invention has been developed principally for small compressors, many of the features will be equally useful in larger screw compressor systems.

In order to become more competitive against piston type compressors, which dominate the small end of the compressor market, the screw type machines must reduce their complexity and size without diminishing their performance advantages. The principal problem with screw compressor machines lies in the arrangement of the oil/air separator. During operation the oil within this separator vessel contains many small bubbles of air which change volume as the pressure is raised or lowered. For example, if the oil contains 10% air at 8 bars, the volume of the air bubbles increases to 80% as they expand to atmospheric pressure. The new oil level is then 180% of the old one and unless steps are taken, oil will directly impinge on the separator element (final filter) causing failure of the separator element and substantial oil droplet carry over in the "clean" compressed air outlet line. Conventionally this problem (particularly in larger sized machines) was solved by increasing the size of the separator vessel but this both increases the size and cost of the compressor system. It is therefore not viable for small machines and is not desirable for larger machines. The conventional alternative most often used to solve this problem is to reduce the oil volume used in the system but while this may solve the oil foaming problem, it overloads the already heavily stressed oil and causes premature oil breakdown with substantially shortened operational periods between shutdowns where the oil has to be replaced.

A further practical requirement in the design of screw compressor systems is the need for easy access to the interior of the separator vessel particularly from the point of view of being able to easily service or replace the separator element or filter. Ease of service also places certain physical constraints on the placement of fixed and removable parts in the compressor system when endeavouring to reduce the overall "package" size of the system.

Co-pending Australian patent application No. 25299/84 discloses arrangements in screw compressor systems wherein a separator element is annularly arranged around a clean air outlet from the separator vessel and includes a dry sump forming member separating at least the lower regions of the separator element from the pool of oil contained within the separator vessel. These arrangements provide substantial advantages in either (or both) reducing the size of the separator vessel and increasing the oil volume capable of being used but because of the geometric arrangements disclosed, particularly in relation to the necessary length/diameter of the separator element to gain sufficient flow surface area, these arrangements cannot provide sufficiently small separator vessels to make screw compressors viable for small compressor systems.

An objective of a first aspect of the present invention is to provide a screw compressor/separator combination providing an improved geometric arrangement of the separator element enabling a marked reduction in the separator vessel size without adversely affecting the operation of the separator element.

Accordingly, the present invention provides a compressor/separator configuration comprising a separator vessel, a compressor arranged relative to said separatcr vessel whereby a substantial portion of the compressor is housed within said separator vessel and a separator element located within said separator vessel such that the separator element is arranged adjacent a circumferential wall of the separator vessel and separates a compressed gas and liquid mixture discharged by the compressor into the separator vessel from a clean gas outlet leading from the separator vessel.

The separator element itself preferably has an annular configuration whereby its axial length is shorter than its width transverse to its axis. Conveniently the separator element is located within a substantially sealed compartment having access means leading therethrough.

Preferably a radial outer surface of the separator element is located closer to the circumferential wall section of the vessel than the distance between a radial inner surface of the element and the longitudinal axis of the vessel.

In one advantageous embodiment the separator vessel includes said circumferential wall section and at least one end wall removably secured to said circumferential wall section, said separator element being arranged adjacent said removable end wall and inwardly of and adjacent to said circumferential wall section. Conveniently the separator element may be mounted from said removable end wall whereby upon removal of the end wall the separator element is also removed.

Conveniently at least one removable end wall is arranged at an end of the vessel opposite to the end mounting the compressor. Preferably the separator element is arranged within a substantially sealed compartment having access means enabling communication of the gas/liquid mixture from the separator vessel to the separator element. The access means may comprise one or more openings arranged in an upper region (in a position of use) of the separator vessel.

In accordance with another aspect of the present invention there is provided a compressor/separator configuration comprising a separator vessel, a compressor arranged substantially within the separator vessel whereby a compressed liquid/gas mixture discharged from said compressor is discharged into said separator vessel, and a separator element whereby gas with entrained liquid from within the separator vessel passes through the separator element to remove the liquid therefrom and directs the gas to a clean gas outlet, said configuration being characterized in that said separator vessel is formed by a cylindrical section, a ring end flange mounting said compressor at one end of said cylindrical section, and an end disc closing the other end of said cylindrical section, the ring end flange extending radially outwardly from an outer surface of said cylindrical section and the end disc extending radially inwardly from an inner surface of the cylindrical section with the end flange and end disc being formed from the same metal plate. Conveniently the outer diameter of the end disc is less than the inner diameter of the end flange. Preferably the difference in said diameters equals twice the thickness of the cylindrical section. In this manner minimum metal wastage can be achieved when constructing the separator vessel with substantially flat end plates or with non-dished ends. This of course is of significant importance when "flat" end plates are used on a pressure vessel which must be much thicker than that which would be required for dished end pressure vessels.

Further preferred features of the present invention will become apparent from the following description of preferred embodiments shown in the accompanying drawings, in which.

Figure 1:
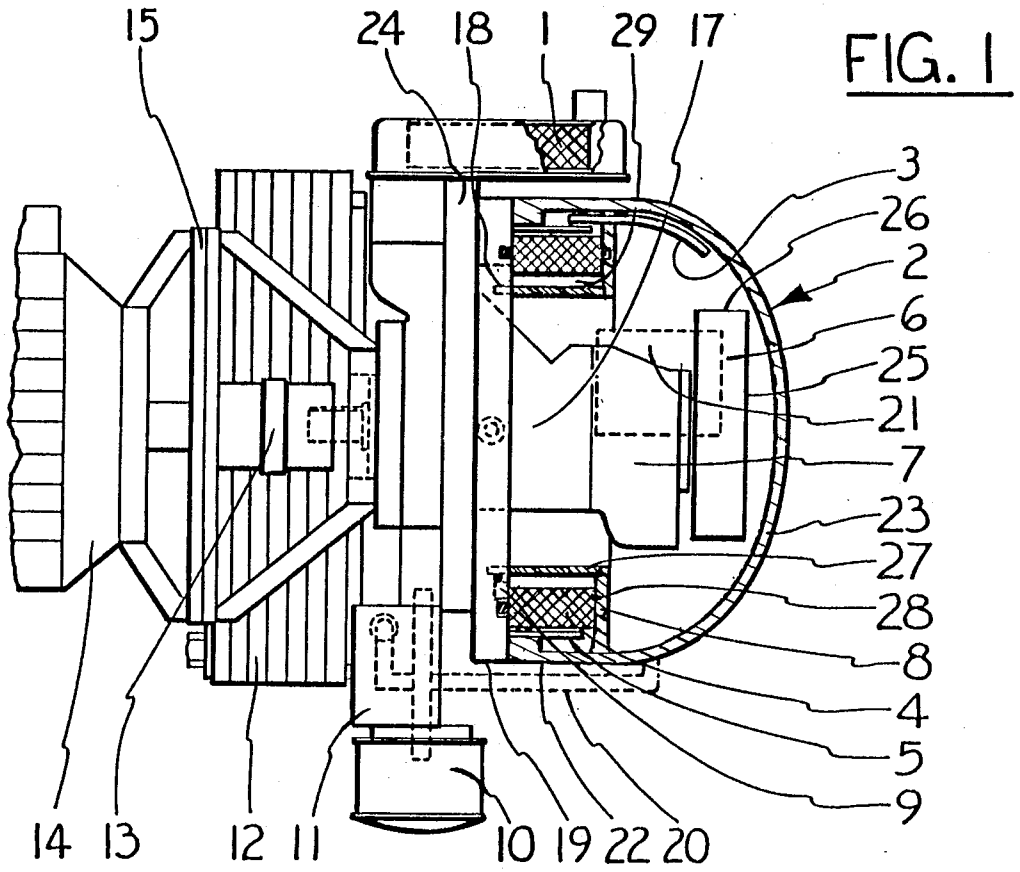
FIG. 1 is a longitudinal cross-sectional schematic view of a first preferred embodiment of the present invention.

Referring first to FIG. 1, the system illustrated includes a separator vessel 2 having a short cylindrical section 22 and a dished end section 23 secured to each other. The vessel sections 22, 23 are joined to an intermediate flange 19 and a compressor (conveniently a screw compressor) 7 is mounted from an end flange 24 such that the compressor 7 extends internally of the separator vessel through the flange 19 and within the space formed by the sections 22,23. An operating motor 14 drives, through a coupling 13, the screw compressor 7. Conveniently an oil cooler 12 together with a cooling fan 15 is provided between the motor 14 and the separator/compressor combination 2,7. An oil filter 10 is arranged to receive oil from the base of separator vessel 2 and after filtering the oil to pass same to the oil cooler 12. Oil from the cooler 12 is then passed to the inlet of the compressor 7 together with atmospheric air via an air filter 1.

The screw compressor 7 is arranged to compress the air and in the process creates an oil/air mixture which is discharged into the separator vessel 2. The discharge is effected onto a discharge assembly 6 which comprises an upwardly divergent plate 25 (which may include upwardly directed channels) arranged to decelerate the flow of the oil/air mixture. At the upper end an inwardly directed shroud 26 directs flow over an oil deareation pad 21. The pad may be any large surface area (compared to volume) material such as steel wool, porous solid plastics or ceramics, expanded metal or the like. These materials tend to deflate any air bubbles (particularly under foaming conditions) to minimize the production of foam. Oil thereby slowly drains into the base region of the vessel and air with small oil droplets entrained tend to move slowly towards the top of the vessel.

Arranged annularly around the compressor 7 adjacent and within the cylindrical wall section 22 of the vessel 2, is a separator element (filter) 4. The filter 4 is wholly contained within a substantially sealed annular compartment 29 forming a dry sump region which is formed in part by the vessel section 22, the intermediate flange 19, an inner annular axially extending wall 27 and an inner radially extending wall 28. An annular axially extending shroud 5 is provided outwardly of the filter 4 extending from the flange 19 to a position adjacent to but spaced from the radial inner wall 28. In the embodiment illustrated the filter 4 is sealed to the flange 19 and the wall 28 by 'o' ring seals, however, any other suitable sealing means might also be provided. In one possible alternative the axial ends of the filter 4 may in fact be bonded by suitable sealing adhesive to the adjacent wall structures.

One or more access or accelerator tubes 3 are provided in the upper regions of the vessel penetrating the wall 28 and extending from a downstream end adjacent to the flange 19 outwardly of the shroud 5 to an upstream end within the vessel 2 adjacent the wall of the section 23. Within the filter 4 there is formed an annular channel 9 within the flange 19 which connects to a radial passage (not shown) leading to a "clean" air discharge port 17.

The accelerator tube or tubes 3 described above serve several functions. Firstly they position exactly the point of entrance to the dry sump 29, which is otherwise completely closed off to the rest of the separator vessel 2. They extend into the dry sump 29, past the end of the shroud 5. They force the air entering the dry sump to first impinge upon a dry sump wall then reverse direction to pass around the end of the shroud 5. They intake air from near the separator vessel wall 23, which is a placid flow region where low velocities prevail and the entrained oil content is low. The cross-sectional flow area of the tubes 3 should be kept low so as to encourage a high internal velocity. To enter the tubes air must undergo high acceleration. It is well known that liquid gas flow in a pipe takes the pattern of the heavier liquid flowing along the pipe walls and the gas flowing through the central core section.

When oil foaming occurs in the separator and the oil foam reaches the entrance of the accelerator tubes, the foam bubbles will be broken by the high acceleration and the oil will run along the tube walls and the air along the center. When it reaches the dry sump the oil will impinge on the dry sump wall and then flow down the shroud 5 to the bottom of the dry sump 9 and be drained away. The second function of the accelerator tubes 3 is to act as snorkels when the compressor axis is vertical with the shaft down, so the intake is away from the liquid portion of the separator. A further advantage of the small cross-sectional area of the accelerator tubes is the restricted access to the dry sump 29 if the vessel is full of foam. The small area means only small amounts of foam can enter the dry sump as opposed to a conventional system. It will of course be appreciated from the following description of other embodiments that the accelerator tubes may be replaced by simple access openings.

The separator element may have a Length/Diameter ratio of 1:2 to 1:6 whereas a conventional separator is 1/1 to 5/1. This large diameter means very low velocities may be attained in the annular regions surrounding the dry sump shroud without taking up very much diametral room. For instance the required clearance may be reduced by a factor of 5–6. The large diameter means a short axial length for the same surface area which enables the separator and dry sump to be placed so it surrounds the compressor 7, which is an area of the separator vessel that was formerly unable to be used and was regarded as 'dead space'. The close clearances between the separator shroud and dry sump means any foam entering the dry sump must contact one of the walls which then collapses the foam because the wall 'wets' the foam and draws off the oil by surface tension.

The discharge from the compressor 7 is where the air bubbles enter the oil and if the formation of bubbles can be supressed the foaming problem becomes less severe. Conventionally the discharge consists of a simple pipe where the velocity is in the order of 7–16 m/s. In conventional machines this may be up to 1 meter long. Obviously a tube 1 meter long with 10 m/s of oil and air turbulently mixing is going to generate many bubbles. This invention, in one aspect, arranges the discharged air/oil to enter the substantially circular diffuser 6 where the velocity never exceeds 3 m/s and is progressively lowered to below 1 m/s where it enters the separator vessel 2. In this arrangement the length of travel is also reduced to less that 0.15 meters. The oil may then be passed over perforated plate or stainless steel mesh or a porous plastic or ceramic like material. The oil contacts the very large surface area and is attracted by surface tension. The large area, low velocity and thin layer of oil means the air may easily escape the attractive effects of the oil and the bubbles may break, thereby destroying the foam and foaming problems. One particularly suitable arrangement would consist of a plane surface with grooves or canals formed into it. As the foam bubbles collapse the oil runs into the canals and is drained away. This system may also be installed in the above mentioned diffuser.

Conventional compressors use a removable separator element or filter 4, which is fitted into the separator vessel 2. This means the element must be structurally sound, have end caps, and be sealed at its flanges to prevent leakages. With the present invention it is now possible to bond the separator element directly to the separator vessel or flange, which eliminates one of the end caps and sealing faces and ensures no leakages past the gasket can occur as the gasket is no longer used.

When compressors are being used in industry, it is often necessary to locate them in small spaces, particularly in regards to floor area. For this application a compressor with a substantially vertical axis may be preferable. While it is possible to manufacture such machines specially, compressors that can operate in both orientations without modification clearly provide a substantial improvement. In the present case the accelerator tubes always induce air from the dry part of the separator, even when the shaft is vertical with the motor beneath the compressor, and so the compressor may be used in either orientation.

One structural difficulty that has arisen in some, although not all, applications of the arrangement disclosed in FIG. 1 is that to remove the separator element for either servicing or replacement the vessel sections 22,23 must be removed from the intermediate flange 19. This does necessitate having clear space in front of the vessel sections to enable the vessel to clear the compressor structure normally housed within the vessel. In some applications this can result in an undesirable increase in overall system package size. To overcome such difficulties in these cases, the present invention, in further preferred embodiments proposes arrangements of the type disclosed in FIGS. 2, 3 and 4.

Figure 2:
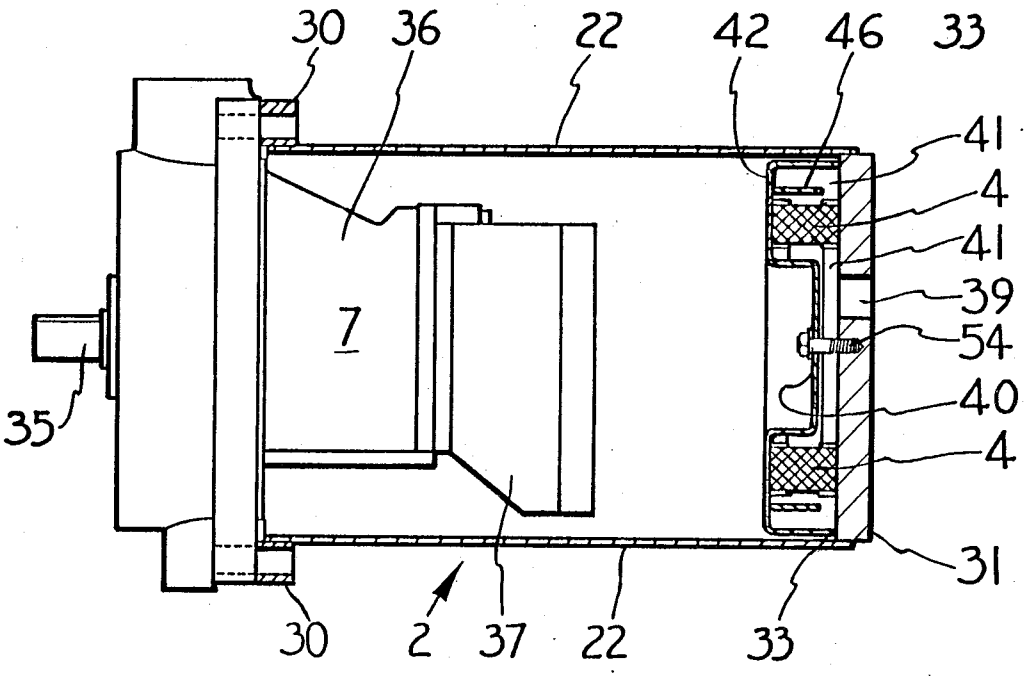
FIG. 2 is a similar longitudinal schematic view of a second preferred embodiment of the present invention.
Figure 3:
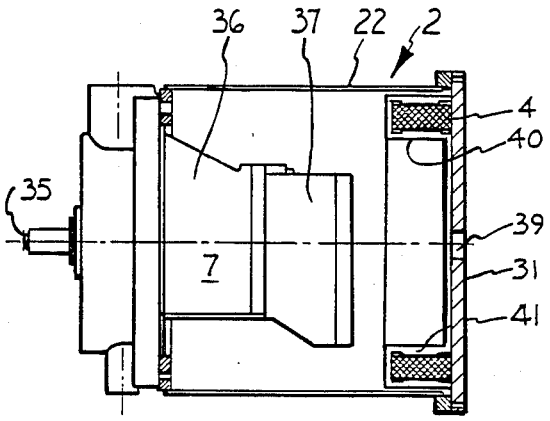
FIGS. 3 and 4 are views of arrangements similar to FIG. 2 wherein the length of the cylindrical section is varied.
Figure 4:
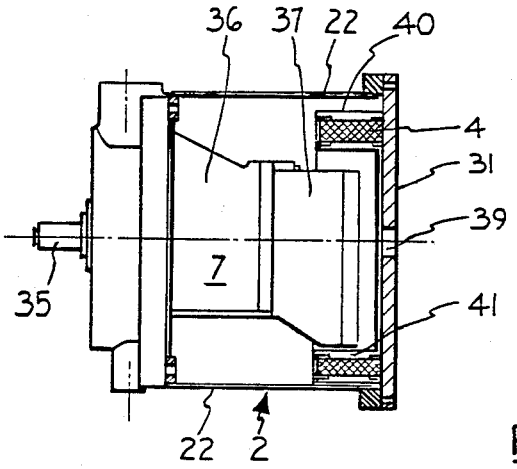

As illustrated in FIGS. 2, 3 and 4 the separator vessel is constructed from a cylindrical wall section 22 with substantially flat opposed end walls 30 and 31. One of the end walls 30 is formed as an annular ring flange fixed to the cylindrical wall section 22 and serves as a mounting flange for mounting the compressor unit 7 as illustrated. The compressor unit is mounted so that a substantial portion is located within the separator vessel. As shown, a drive shaft 35 projects outwardly and is arranged for connection to a suitable drive means not illustrated. The complete compressor system would include those additional integers described in FIG. 1 and as with FIG. 1 the compressor unit body 36 and particularly the gas discharge end 37 are located within the separator vessel.

The other end wall 31 of the separator vessel is substantially flat and is removable in the embodiments of FIGS. 3 and 4 from the cylindrical wall section 22. Suitable removable bolts or other fastening means (not shown) may be provided to allow the end wall 31 to be removed to gain service access to the interior of the separator vessel. The clear space required in front of the end wall clearly is a minimum to allow removal of the wall 31 when compared with that required to remove the unitary cylindrical wall and dished end of the separator vessel illustrated in FIG. 1. It is, of course, necessary for the end wall 31 to be much thicker or stronger than the remaining cylindrical shell section, however, this disadvantage is counteracted by the simplified construction techniques and the improved configuration of the overall design.

As shown in FIGS. 2 to 4, a final separator element or filter 4 is mounted adjacent the end wall 31 and extending inwardly of the separator vessel. The separator element 4 is preferably annular in shape and is arranged adjacent to the cylindrical wall section 22. As a result, the separator element has a relatively short axial length and a relatively large diametral distance. The configuration of the element 4 can be similar to that described in relation to FIG. 1 surrounding a clean gas outlet 39 located in the end wall 31. Furthermore, a partition wall 40 is provided generally surrounding the separator element 4 to provide a substantially sealed compartment 41 therefore except for access means located in an upper region (in a position of use) to enable flow of a gas/liquid mixture from the separator vessel to the separator element. Various access means may be provided and are better illustrated and described hereinafter with reference to FIGS. 5 to 7. The compartment wall 40 may be connected to either the cylindrical section wall 22 or the removable end wall 31.

One difference that exists between the embodiments illustrated in FIGS. 2 to 4 is in the length of the cylindrical section 22. In FIG. 2, the free axial end of the separator element 4 is located spaced from the discharge end 37 of the compressor. In FIG. 4, the separator element 4 substantially surrounds or encircles the discharge end 37 of the compressor. In FIG. 3, the separator element is adjacent the discharge end 37 of the compressor. In each instance, the length and therefore volume available within the separator vessel 2 is varied.

In FIG. 2, there is shown a further preferred alternative embodiment in that the end wall 31 is not itself removable. In this embodiment the end wall 31 is welded to one end of the cylindrical section 22 and the other end flange 30 is removably mounted to the compressor unit 7. The end flange 30 in this instance fits over the outer end surface of the cylindrical section 22 and is welded thereto with the end wall 31 being cut from the same metal plate as end flange 30 and fits within the opposed end of the cylindrical section 22.

This arrangement provides a simplified assembly with minimum metal wastage. Moreover, because of the construction used, the diameter of the cylindrical section 22 can be kept to a minimum for the size of the compressor unit used. The axial length of the cylindrical section 22 can be varied as with FIGS. 3 and 4, however, this arrangement would be preferred for smaller sized machines and therefore the axial length would preferably be kept as low as possible.

In this embodiment, the partition wall 40 is formed as a metal cover sealed annularly at 33 to the end wall 31 encasing the element 4. Access openings 42 provided in an upper region of the cover 40 enable the gas/liquid mixture to flow to the separator element around a pre-separator baffle 46. A bolt 54 is provided to hold the cover 40 in position.

Figure 5:
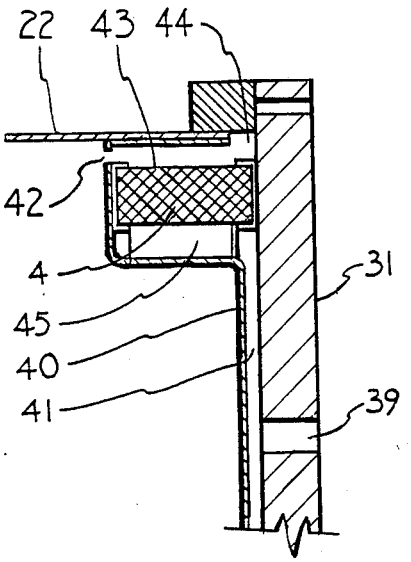
FIGS. 5, 6 and 7 are partial cross-sectional detail views showing possible variations to the upper entrance region to the separator element.
Figure 6:
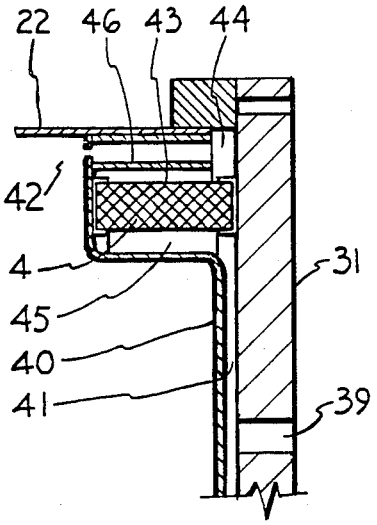
Figure 7:
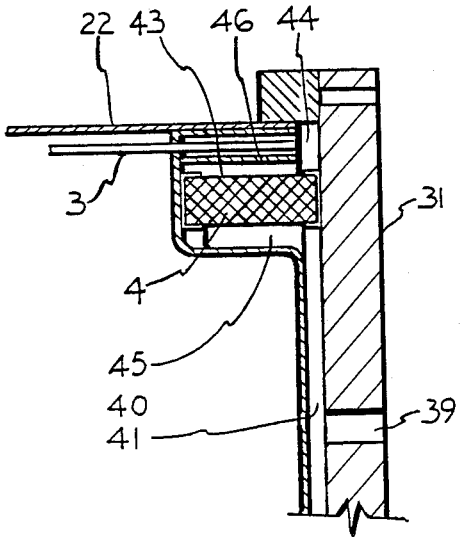

FIGS. 5 to 7 illustrate different variations of access means to the substantially sealed compartment 41. In FIG. 5 access is provided by one or more openings 42 leading through the wall 40 directly to the circumferentially outer face 43 of the separator element 4. The opening(s) 42 is/are located in an upper region of the wall 40 of the separator when located in a position of use. In this manner, compressed gas with liquid droplets carried thereby can pass to the annular zone 44 around the outer face 43 of the separator element 18. The gas then passes through the separator element and across the inner zone 45 to the clean gas outlet 39. Liquid taken from the gas/liquid mixture by the element 4 can collect in the bottom of the compartment 41 and can be removed therefrom by any suitable means. FIG. 6 shows a variation on the arrangement of FIG. 5, somewhat similar to FIG. 2, employing an annular baffle 46 dividing the outer zone 44. The gas/liquid mixture is thereby caused to flow around the baffle before reaching the surface 43 of the separator element. The baffle assists in removing liquid initially from the mixture and also protects the surface 43 to some extent from heavy liquid concentrations. The arrangement differs from FIG. 3 in that the cover wall 40 is secured to the cylindrical section 22 rather than the adjacent end wall. FIG. 7 illustrates a further embodiment employing an accelerator tube 3 as described in more detail with reference to FIG. 1. It will, of course, be appreciated that the baffle 46 might be reversed by being connected to the end wall 31 rather than the partition wall 40.

Figure 8:
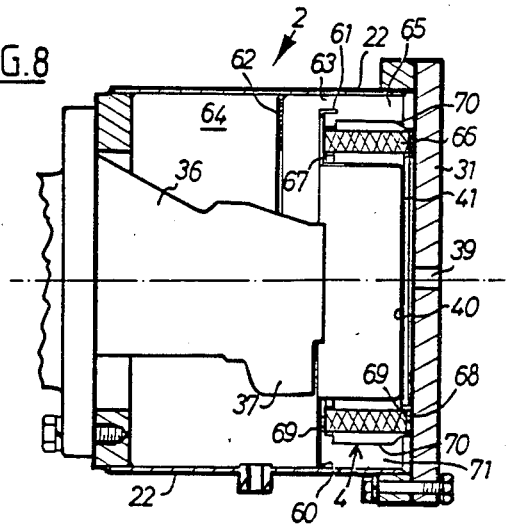
FIGS. 8 and 9 are longitudinal cross-sectional schematic views of two further alternative preferred embodiments.

In FIG. 8 of the drawings a configuration generally similar to FIG. 3 is illustrated. In this configuration the partition wall 40 is welded at its peripheral edge 60 to the cylindrical wall 22 except for a short segmental region located in the upper portion of the vessel 2. This region is bent towards the end wall 31 to form a flange 61. A pre-separator baffle 62 is provided forward of the segmental opening 63 formed above the flange 61. The baffle 62 may extend radially inwardly from the vessel cylindrical wall 22 and circumferentially covering the opening 63. In this manner compressed gas/oil mixture discharged into zone 64 of the separator vessel is forced to flow under the baffle 62 upwardly through the opening 63 and to the zone 65 immediately above the separator element 4. The filter element 66 of the separator element 4 is annularly disposed within the compartment 41 formed by the partition wall 40 and is held by respective end caps 67,68. The caps themselves are sealed against the wall 40 and the vessel end wall 31 by annular seals 69. The end cap 68 adjacent the end wall 31 has an extended annular flange portion 70 that diverges from the filter element 66 and extends forwardly to a position between the flange 61 and the filter element 66. In this manner any liquid that may collect on the free edge of the flange 61 will not drip onto the filter element but rather will be collected on the flange portion 70. Moreover, the gas/liquid mixture passing through the opening 63 will be directed against the end wall 31 where liquid droplets will initially separate from the gas, collect on the flange 70 and run down to the base zone 71 of the compartment 41 where it can be suitably scavenged (removed) by means not illustrated. The gas flow necessarily follows a path through the opening 63, between the flanges 61,70, through the filter element 66 and eventually to the clean gas outlet 39.

Figure 9:
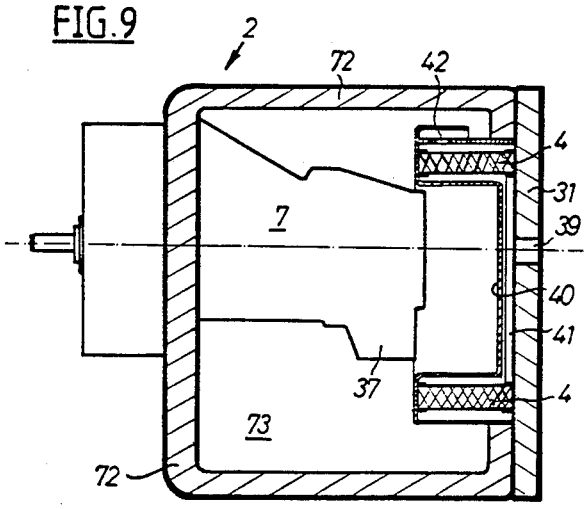

FIG. 9 illustrates a further preferred embodiment. The essential difference between this embodiment and previously described arrangements is that the separator vessel 2 is formed as a casting integral with the housing casting of the compressor 7. While the vessel 2 necessarily has substantially thicker walls 72 (because it is a casting) than the assembled embodiments, this arrangement has the substantial advantage of avoiding machining assembly costs associated with one end of the vessel 2. This can provide significant cost savings. Moreover, because the vessel is a casting it is possible to arrange its shape to provide greater volume in its base region 73 to accommodate greater volumes of oil. Equally the compressor unit 7 may be eccentrically arranged upwardly and similarly, if desired, the separator element 4 may also be eccentrically arranged. This may be done with other embodiments but in no circumstance will the diameter of the separator element be less than one half the diameter of the vessel 2. The end wall 31 carrying the clean gas outlet 39 from the compartment 41 formed by the partition wall 40 may be secured to the cast walls 72 of the vessel 2 by any suitable means such as bolts or the like.

We claim:

1. A compressor/separator configuration comprising a separator vessel having a circumferential wall section closed at either end by first and second end wall sections, at least one of said first and second end wall sections being removable from said circumferential wall section, a compressor mounted to or comprising said first end wall section whereby a substantial portion of the compressor is housed within said separator vessel, and a separator element having an annular wall of filter material with an axis coincident with or parallel to a longitudinal axis of said circumferential wall section of the separator vessel, said separator element being located within a substantially closed compartment within said separator vessel such that the annular wall of the separator element is arranged adjacent to the circumferential wall section of the separator vessel, access opening means establishing communication between said closed compartment and a first zone within said separator vessel into which a compressed gas and liquid mixture is discharged by the compressor, said access opening means being located adjacent an upper wall region of the circumferential wall section of the separator vessel in a position of use of the compressor/separator configuration, said separator element separating said first zone from a clean gas outlet leading from the separation vessel whereby the compressed gas and liquid mixture discharged into the first zone passes therefrom through said access opening means to said closed compartment, the compressed gas of said mixture passing through the filter material of said separator element to said clean gas outlet and the liquid of said mixture being collected in said closed apartment to be removed therefrom by drain means leading from a lower region of said closed compartment.

2. A compressor/separator configuration according to claim 1 wherein the separator element has an axial length less than its width transverse to its axis.

3. A compressor/separator configuration according to claim 2 wherein the ratio of the axial length to the width transverse to its axis of the separator element is within the range of 1:2 to 1:6.

4. A compressor/separator configuration according to claim 1 wherein the separator element is eccentrically arranged relative to the axis of the separator vessel.

5. A compressor/separator configuration according to claim 1 wherein the separator element substantially surrounds the compressor.

6. A compressor/separator configuration according to claim 1 wherein the separator element is spaced from the compressor along a longitudinal axis of the separator vessel.

7. A compressor/separator configuration according to claim 1 wherein said separator element is located adjacent to the second end wall section.

8. A compressor/separtor configuration according to claim 7 wherein said first end wall section is removably attached to the cylindrical section of the separator vessel.

9. A compressor/separator configuration according to claim 1 wherein said second end wall section comprises a plate fitting within a first end portion of the cylindrical section and rigidly secured thereto, the compressor being mounted from a ring flange element rigidly secured to an outer surface of a second end zone of the cylindrical section opposed to said first end portion.

10. A compressor/separator configuration according to claim 1 wherein the first end wall section and the circumferential wall section of the separator vessel are integrally cast with a housing of the compressor.

* * * * *

UNITED STATES PATENT AND TRADEMARK OFFICE

CERTIFICATE OF CORRECTION

PATENT NO. : 4,761,166

DATED : August 2, 1988

INVENTOR(S) : Anthony J. Kitchener and Gerd Cromm

It is certified that error appears in the above-identified patent and that said Letters Patent is hereby corrected as shown below:

Column 8, line 63, "apartment" should be -- compartment --.

Column 10, line 4, "separtor" should be -- separator --.

Signed and Sealed this

Eleventh Day of April, 1989

*Attest:*

*Attesting Officer*

DONALD J. QUIGG

*Commissioner of Patents and Trademarks*